US008350644B2

(12) United States Patent
Fan et al.

(10) Patent No.: US 8,350,644 B2
(45) Date of Patent: Jan. 8, 2013

(54) BAND PASS FILTER COMBINER

(75) Inventors: Che Yao Fan, Hsinchu (TW); Hong Ru Suchen, Hsinchu (TW)

(73) Assignee: Microelectronics Technology, Inc., Hsinchu (TW)

( * ) Notice: Subject to any disclaimer, the term of this patent is extended or adjusted under 35 U.S.C. 154(b) by 504 days.

(21) Appl. No.: 12/638,326

(22) Filed: Dec. 15, 2009

(65) Prior Publication Data

US 2011/0140804 A1 Jun. 16, 2011

(51) Int. Cl.
*H01P 5/12* (2006.01)

(52) U.S. Cl. ..... 333/134; 333/126; 333/129

(58) Field of Classification Search ..... 333/126–129, 333/132, 134–136
See application file for complete search history.

(56) References Cited

U.S. PATENT DOCUMENTS 5,150,084 A * 9/1992 Asa et al. ..... 333/128

* cited by examiner

*Primary Examiner* — Robert Pascal
*Assistant Examiner* — Kimberly Glenn
(74) *Attorney, Agent, or Firm* — WPAT, P.C.; Anthony King

(57) ABSTRACT

A band pass filter combiner carrying a broadband signal with a central frequency comprises a power divider, a high pass band filter, a low pass band filter, and a power combiner. The distance from the signal input port of the power divider to each of signal input ports of the high pass band filter and the low pass band filter is equal to a quarter of the wavelength at the central frequency. The distance from each of signal output ports of the high pass band filter and the low pass band filter to the signal output port of the power combiner is also equal to a quarter of the wavelength at the central frequency.

16 Claims, 6 Drawing Sheets

BAND PASS FILTER COMBINER

BACKGROUND OF THE INVENTION (A) Field of the Invention

The present invention relates to a band pass filter combiner, and more particularly, to a circuit coupling band pass filters through power divider patterns for filtering unwanted noise.

(B) Description of the Related Art

FIG. 1 is a schematic diagram of a conventional band pass filter combiner. A band pass filter combiner 10 comprises a 3 dB power divider 11, a high pass band filter 12, a low pass band filter 13, and a 3 dB power combiner 14. A broadband signal is input into the band pass filter combiner 10 from the feed-in point of the 3 dB power divider 11, and a spur signal occurring in a low band immediately after the desired main band of the broadband signal are also input therein. The 3 dB power divider 11 splits the broadband signal and the spur into two half-power signals. Thereafter, two half-power signals are respectively transmitted by two transmission lines, and are respectively filtered by the high pass band filter 12 and the low pass band filter 13. Accordingly, a desired high band signal and a desired low band signal can pass through the transmission lines and reach the 3 dB power combiner 14 together. Finally, the high band signal and the low band signal are combined to create a whole band signal without any undesired spur signals by the 3 dB power combiner 14.

The 3 dB power divider 11 and the 3 dB power combiner 14 are Wilkinson power divider formed on a printed circuit board, and the high pass band filter 12 and the low pass band filter 13 can be band pass filter pair patterns also formed on the printed circuit board. However, such Wilkinson power divider and band pass filter pair patterns degrade the return loss of each pass band, and accordingly, the insertion loss of each pass band is increased. FIG. 2 is a diagram illustrating the return loss S(1,1) and the insertion loss S(2,1) of the band pass filter combiner 10. The insertion loss S(2,1) of each pass band is less than 6 dB. Therefore, the conventional band pass filter combiner 10 needs further improvement in electrical performance.

SUMMARY OF THE INVENTION

The first embodiment of the present invention is a band pass filter combiner carrying a broadband signal with a central frequency. The band pass filter combiner comprises a power divider, a high pass band filter, a low pass band filter, and a power combiner. The distance from the signal input port of the power divider to each of the signal input ports of the high pass band filter and the low pass band filter is equal to a quarter of the wavelength at the central frequency. The distance from each of the signal output ports of the high pass band filter and the low pass band filter to the signal output port of the power combiner is also equal to a quarter of the wavelength at the central frequency.

Each of the power divider and the power combiner is a stepwise pattern formed on a printed circuit board. The stepwise pattern is a pattern having a symmetric line parallel to the direction of signal transmission.

BRIEF DESCRIPTION OF THE DRAWINGS

The objectives and advantages of the present invention will become apparent upon reading the following description and upon reference to the accompanying drawings in which.

DETAILED DESCRIPTION OF THE INVENTION

The present invention is related to a band pass filter combiner. For the purpose of understanding the present invention thoroughly, the descriptions below illustrate detailed steps and the compositions thereof. Clearly, the embodiment of the present invention is not limited to the particular method or the system familiar to those skilled in the art of the band pass filter combiner. On the other hand, the ordinary skills in the art are not illustrated to avoid unnecessary limitations on the present invention. The preferred embodiments are illustrated below but the present invention may be utilized in other practices and should not be limited by such illustrated embodiments. The scope of the present invention should be interpreted in light of the claims.

Figure 1:
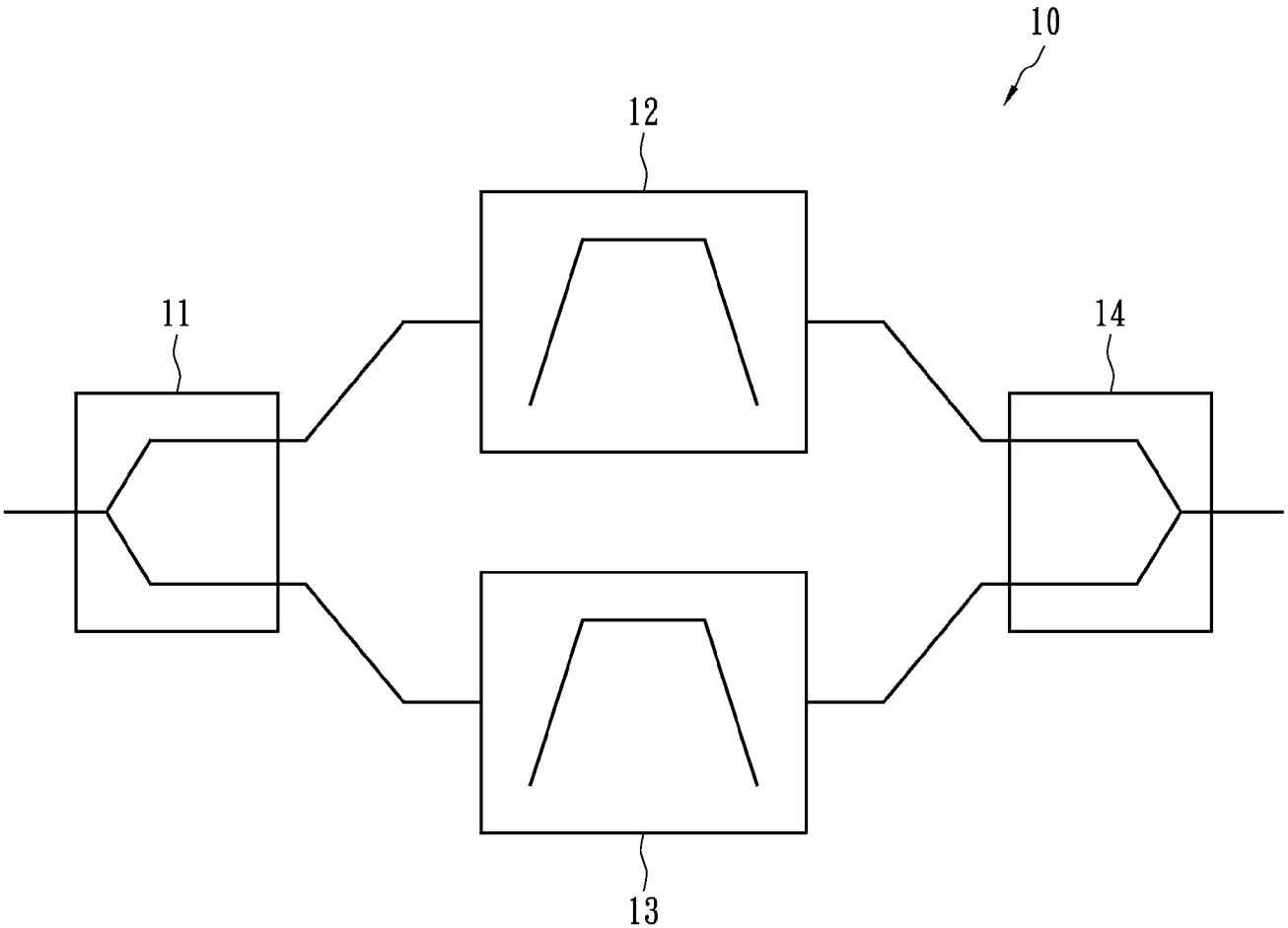
FIG. 1 (Prior Art)
FIG. 1 is a schematic diagram of a conventional band pass filter combiner.
Figure 2:
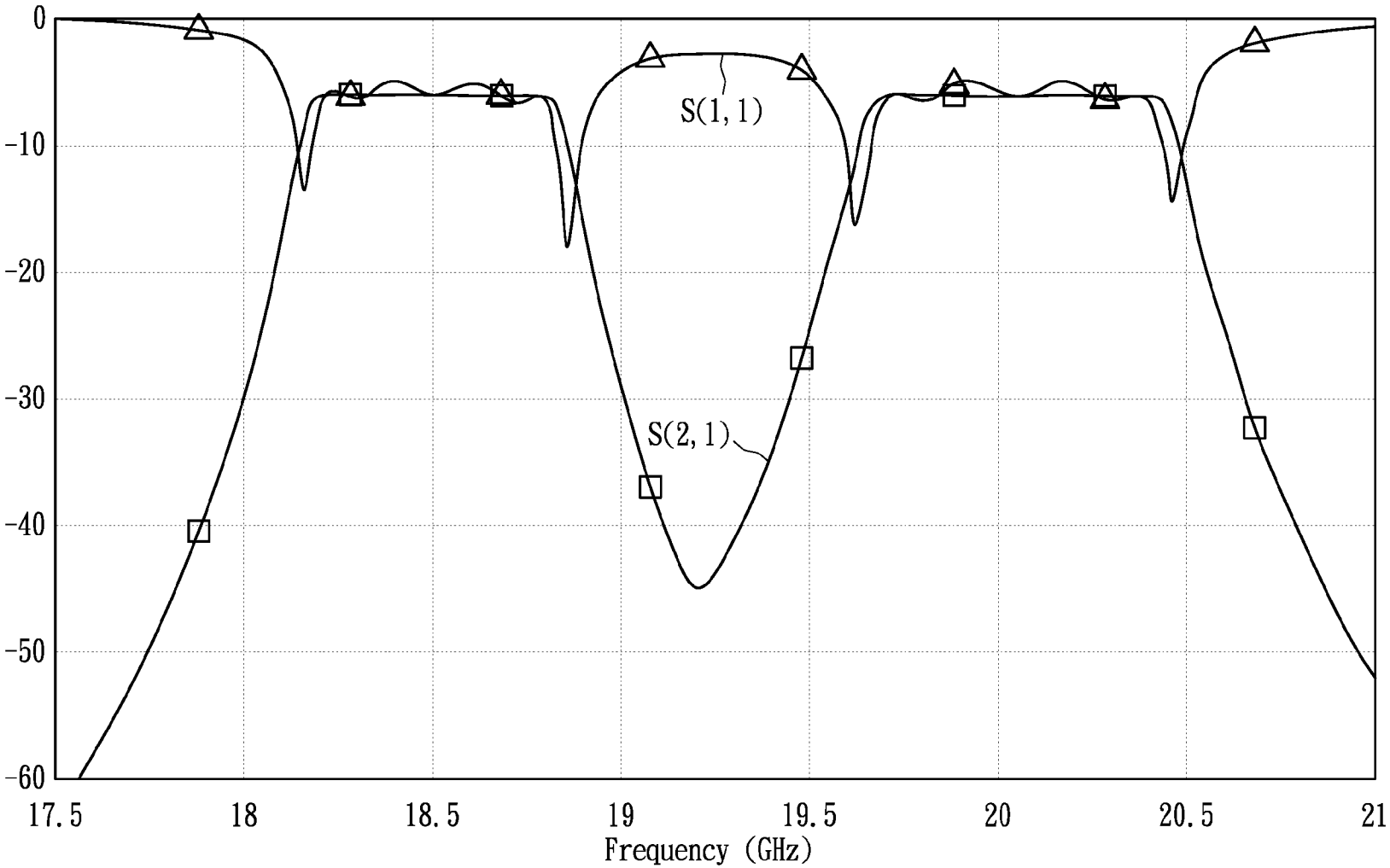
FIG. 2 (Prior Art)
FIG. 2 is a diagram illustrating the return loss S(1,1) and the insertion loss S(2,1) of the band pass filter combiner 10.
Figure 3:
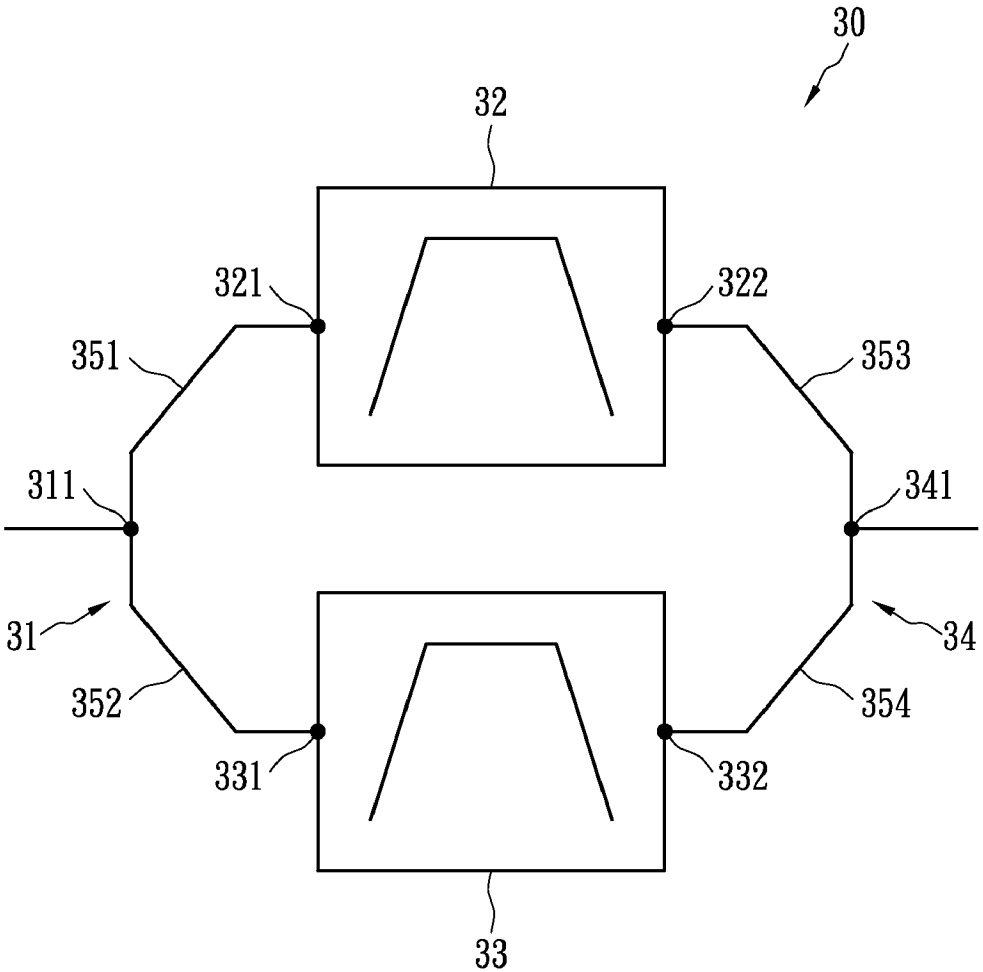
FIG. 3 is a schematic diagram of a band pass filter combiner in accordance with the first embodiment of the present invention.

FIG. 3 is a schematic diagram of a band pass filter combiner in accordance with the first embodiment of the present invention. A band pass filter combiner 30 carries a broadband signal with a central frequency, and can filter a spur signal occurring in a low band immediately after the desired main band of the broadband signal. The band pass filter combiner 30 comprises a power divider 31, a high pass band filter 32, a low pass band filter 33, and a power combiner 34. The broadband signal and the spur signal are input to the power divider 31 through the signal input port 311, and are split into two half-power signals. The two half-power signals are respectively transmitted by two transmission lines 351 and 352 which are respectively connected to signal input ports 321 and 331 of the high pass band filter 32 and the low pass band filter 33. Accordingly, a desired high band signal and a desired low band signal can respectively reach transmission lines 353 and 354 through signal output ports 322 and 332, and combine at the signal output port 341 of the power combiner 34.

The distance from the signal input port 311 of the power divider 31 to each of the signal input ports (321, 331) of the high pass band filter 32 and the low pass band filter 33 is equal to a quarter of the wavelength at the central frequency. For example, when the wavelength at a central frequency of 19 GHz is λ, the aforesaid distance is preferably a quarter of λ. Furthermore, the distance from each of the signal output ports (322, 332) of the high pass band filter 32 and the low pass band filter 33 to the signal output port 341 of the power combiner 34 is also equal to a quarter of the wavelength at the central frequency.

Figure 4:
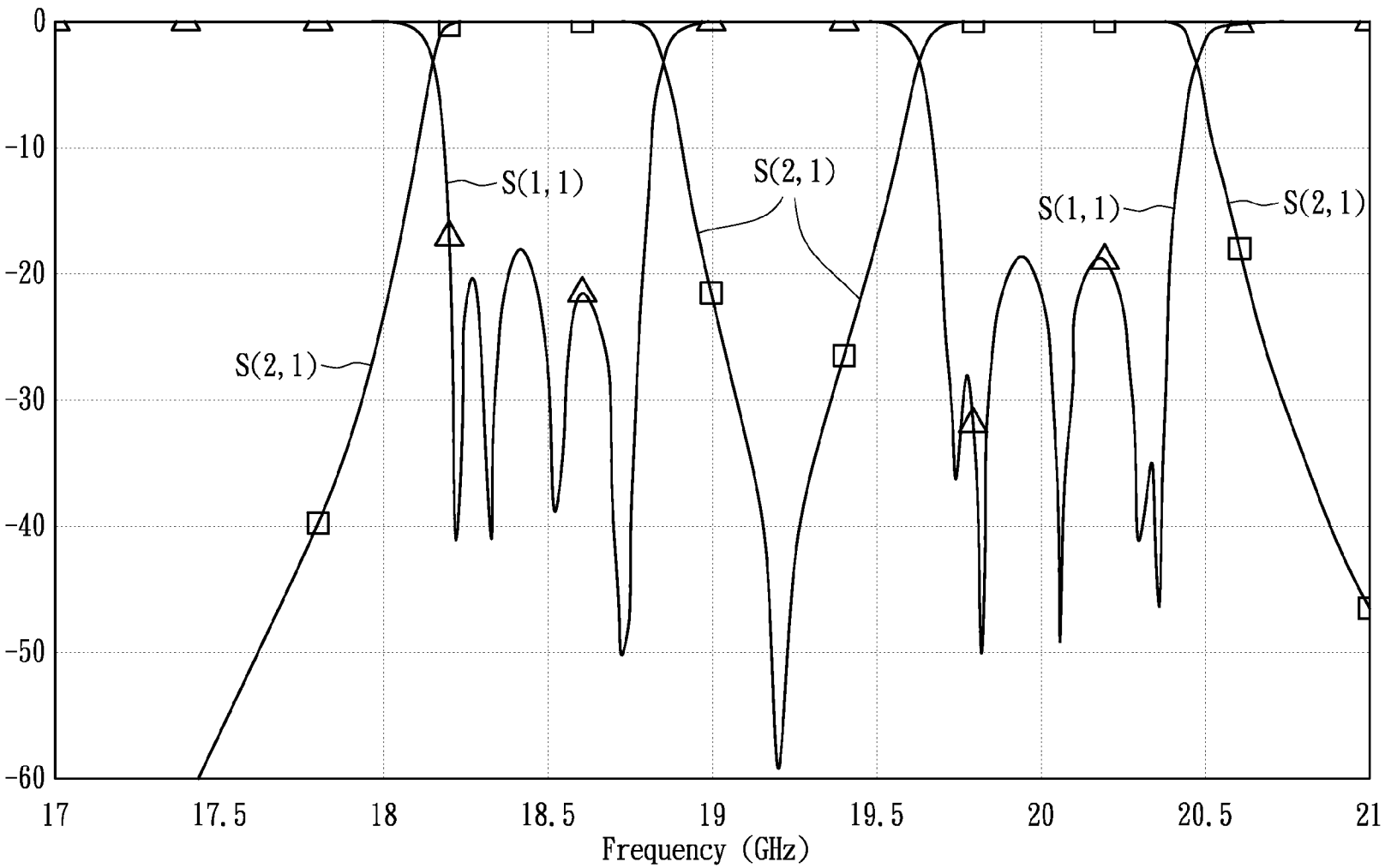
FIG. 4 is a diagram illustrating the return loss S(1,1) and the insertion loss S(2,1) of the band pass filter combiner 30.

FIG. 4 is a diagram illustrating the return loss S(1,1) and the insertion loss S(2,1) of the band pass filter combiner 30. The insertion loss S(2,1) within the working band of each pass band is very low. Furthermore, because each length of the transmission lines 351-354 is a quarter of the wavelength, the entire size of the band pass filter combiner 30 can also be significantly decreased.

Figure 5:
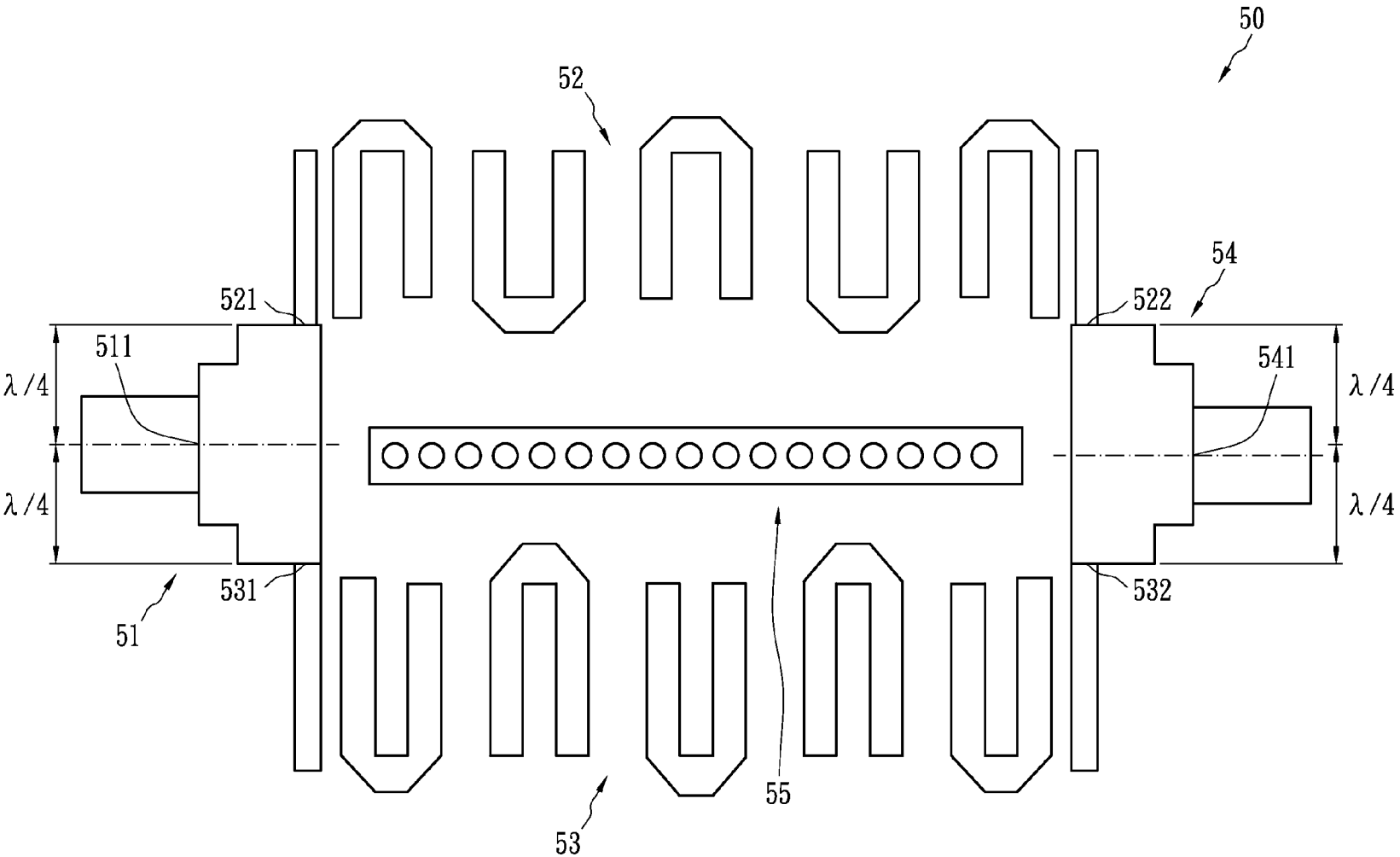
FIG. 5 shows patterns of a band pass filter combiner on a printed circuit board in accordance with the second embodiment of the present invention.

FIG. 5 shows patterns of a band pass filter combiner on a printed circuit board in accordance with the second embodiment of the present invention. A band pass filter combiner 50 comprises a power divider pattern 51, a high pass band filter 52, a low pass band filter 53, and a power combiner 54. Each pattern of the power divider 51 and the power combiner 54 is a stepwise pattern formed on a printed circuit board (not shown). The stepwise pattern is a pattern having a symmetric line parallel to the direction of signal transmission (from left to right). The distance from the symmetric line of the power divider 51 to each of the signal input ports (521, 531) of the high pass band filter 52 and the low pass band filter 53 is equal to a quarter of the wavelength at the central frequency. Such an optimal distance can make the band pass filter combiner 50 have optimal electrical performance and minimal size. The high pass band filter 52 and the low pass band filter 53 respectively comprise a plurality of band pass filter pairs, each of which is formed in a U-shaped pattern.

A mixed signal comprising a combination of a broadband signal and a spur signal is input to the power divider 51 through the signal input port 511, and is split into two half-power signals. The two half-power signals are respectively transmitted to signal input ports (521, 531) of the high pass band filter 52 and the low pass band filter 53. Accordingly, a desired high band signal and a desired low band signal can respectively reach the signal output ports 522 and 532, and combine at the signal output port 541 of the power combiner 54. The distance from the symmetric line of the power combiner 54 to each of signal output ports (522, 532) of the high pass band filter 52 and the low pass band filter 53 is equal to a quarter of the wavelength at the central frequency. The signal input ports 521 and 531 are aligned with each other, and the signal output ports 522 and 532 are also aligned with each other.

An isolating portion 55 can be placed between the high pass band filter 52 and the low pass band filter 53 to prevent the transmission signal passing through one filter from leaking to the other filter. An isolating wall (not shown) is perpendicularly erected on the plane where the band pass filter combiner 50 is disposed.

Figure 6:
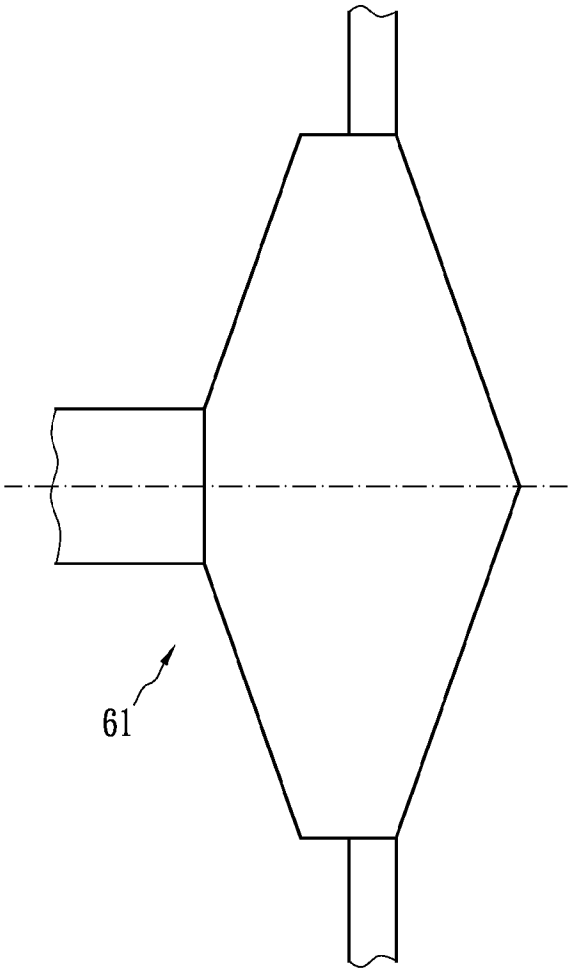
FIG. 6 shows another pattern of the power divider in accordance with the third embodiment of the present invention.

FIG. 6 shows another pattern of the power divider in accordance with the third embodiment of the present invention. The pattern of the power divider 61 is a polygon. Adjustments to characteristics of the power divider 6 can be made by changing the shape of the polygon. The patterns of the power divider and the power combiner are not limited to the aforesaid shapes.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A band pass filter combiner carrying a broadband signal with a central frequency, comprising:

a power divider including a signal input port;

a high pass band filter including a signal input port electrically connected to the power divider and a signal output port;

a low pass band filter including a signal input port electrically connected to the power divider and a signal output port; and a power combiner including a signal output port and electrically connected to the signal output port of the high pass band filter and the signal output port of the low pass band filter;

wherein a distance from the signal input port of the power divider to each of the signal input ports of the high pass band filter and the low pass band filter is substantially equal to a quarter of the wavelength at the central frequency.

2. The band pass filter combiner of claim 1, wherein the distance from each of the signal output ports of the high pass band filter and the low pass band filter to the signal output port of the power combiner is substantially equal to a quarter of the wavelength at the central frequency.

3. The band pass filter combiner of claim 1, wherein each of the power divider and the power combiner is a stepwise pattern formed on a printed circuit board.

4. The band pass filter combiner of claim 1, wherein the stepwise pattern is a pattern having a symmetric line parallel to a direction of signal transmission.

5. The band pass filter combiner of claim 1, further comprising an isolating portion placed between the high pass band filter and the low pass band filter for signal isolation.

6. The band pass filter combiner of claim 5, further comprising an isolating wall erected on the isolating portion.

7. The band pass filter combiner of claim 1, wherein the high pass band filter and the low pass band filter respectively comprise a plurality of band pass filter pairs.

8. The band pass filter combiner of claim 1, wherein each of the power divider and the power combiner is a polygon pattern formed on a printed circuit board.

9. A band pass filter combiner carrying a broadband signal with a central frequency, comprising:

a power divider including a signal input port;

a high pass band filter including a signal input port electrically connected to the power divider and a signal output port;

a low pass band filter including a signal input port electrically connected to the power divider and a signal output port; and a power combiner including a signal output port and electrically connected to the signal output port of the high pass band filter and the signal output port of the low pass band filter;

wherein a distance from a symmetric line of the power combiner to each of the signal output ports of the high pass band filter and the low pass band filter is equal to a quarter of the wavelength at the central frequency.

10. The band pass filter combiner of claim 9, wherein the distance from each of the signal output ports of the high pass band filter and the low pass band filter to a symmetric line of the power combiner is substantially equal to a quarter of the wavelength at the central frequency.

11. The band pass filter combiner of claim 9, wherein each of the power divider and the power combiner is a stepwise pattern formed on a printed circuit board.

12. The band pass filter combiner of claim 11, wherein the stepwise pattern is a pattern having the symmetric line parallel to a direction of signal transmission.

13. The band pass filter combiner of claim 9, further comprising an isolating portion placed between the high pass band filter and the low pass band filter for signal isolation.

14. The band pass filter combiner of claim 13, further comprising an isolating wall erected on the isolating portion.

15. The band pass filter combiner of claim 9, wherein the high pass band filter and the low pass band filter respectively comprise a plurality of band pass filter pairs.

16. The band pass filter combiner of claim 9, wherein each of the power divider and the power combiner is a polygon pattern formed on a printed circuit board.

* * * * *